US007506495B2

(12) United States Patent
Cazzola

(10) Patent No.: US 7,506,495 B2
(45) Date of Patent: Mar. 24, 2009

(54) PERFECTED CHAIN FOR ORNAMENTAL ITEMS

(75) Inventor: Umberto Cazzola, Vicenza (IT)

(73) Assignee: FOPE S.r.l., Vicenza (IT)

( * ) Notice: Subject to any disclaimer, the term of this patent is extended or adjusted under 35 U.S.C. 154(b) by 0 days.

(21) Appl. No.: 11/854,789

(22) Filed: Sep. 13, 2007

(65) Prior Publication Data

US 2008/0168760 A1 Jul. 17, 2008

(51) Int. Cl.
*F16G 13/00* (2006.01)
*A44C 5/08* (2006.01)

(52) U.S. Cl. ..... 59/79.1; 59/79.3; 59/80

(58) Field of Classification Search ..... 59/78, 59/80, 79.1, 79.3, 85, 93, 79.2
See application file for complete search history.

(56) References Cited

U.S. PATENT DOCUMENTS

| | | | | |
|---|---|---|---|---|
| 896,865 | A * | 8/1908 | Speidel | 59/79.3 |
| 1,085,520 | A * | 1/1914 | Anderson | 59/79.3 |
| 1,179,876 | A * | 4/1916 | Wagner | 59/80 |
| 1,198,925 | A * | 9/1916 | Jones | 59/79.3 |
| 1,519,799 | A * | 12/1924 | Reed | 59/79.3 |
| 1,659,438 | A * | 2/1928 | Nelson | 59/79.3 |
| 2,591,778 | A * | 4/1952 | Brecht | 59/79.3 |
| 6,978,596 | B1 * | 12/2005 | Lee | 59/79.1 |

FOREIGN PATENT DOCUMENTS

| | | |
|---|---|---|
| FR | 388294 A | 8/1908 |
| GB | 168191 A | 9/1921 |

OTHER PUBLICATIONS

"Les Types De Chaines", La France Horlogere, Societe Millot et Cie, May 1, 1990, p. 106, Figures 11a, 11b & 11c, No. 513, Issn: 0015-9573, Besancon, France.

* cited by examiner

*Primary Examiner*—David B Jones
(74) *Attorney, Agent, or Firm*—IP Strategies

(57) ABSTRACT

The invention is a chain comprising a plurality of cage-shaped elements connected in succession, the cage-shaped element comprising a central body from which two or more lateral bodies branch off whose free ends are arranged opposite each other, slidingly inserted in another cage-shaped element adjacent to the cage-shaped element and facing the corresponding central body. The chain comprises an elastic element interposed between the free ends of the lateral bodies of each cage-shaped element and the central body of the adjacent cage-shaped element.

16 Claims, 4 Drawing Sheets

PERFECTED CHAIN FOR ORNAMENTAL ITEMS

BACKGROUND OF THE INVENTION

The present invention concerns a perfected chain particularly suited to be used for making ornamental items, for example necklaces or bracelets.

The invention also concerns an ornamental item comprising the above mentioned perfected chain.

Innumerable embodiments of chains for ornamental items are known, comprising a plurality of elements connected to one another in succession.

According to one of said known embodiments, the chain comprises a plurality of cage-shaped elements connected in succession, each one of which is constituted by a central body from which two or more lateral bodies branch off whose free ends are arranged opposite each other and inserted in an adjacent cage-shaped element, facing the corresponding central body.

The lateral bodies delimit the cage-shaped element laterally and are spaced from each other in such a way as to define slots that slidingly house the free ends of an adjacent cage-shaped element.

The chain described above is deformable and extensible in such away as to adapt to the wrist or neck of the person who wears it, since each cage-shaped element can slide in the adjacent cage-shaped element and can assume various inclinations with respect to it.

Furthermore, the above mentioned chain is particularly simple, since it comprises a single type of modular element that can be connected to other analogous elements in any number desired, in order to make chains having various lengths.

However, it has the limitation that it is not elastic and, therefore, does not spontaneously fit tightly to the body of the person who wears it.

The above mentioned limitation poses the drawback that the chain must be made to size.

Besides, it poses a further drawback represented by the fact that it needs an opening device that allows it to be put on.

The object of the present invention is to overcome the above-mentioned limitation and drawbacks that are typical of the known art.

SUMMARY OF THE INVENTION

In particular, it is the object of the present invention to make a chain for ornamental items of the type described above that is also elastic.

It is a further object of the present invention to carry out a modular elastic chain.

The objects mentioned above have been achieved through the design of a chain according to the main claim.

The objects mentioned above are also achieved by an ornamental item comprising a chain carried out according to the present invention.

Other details of the invention are described in the dependent claims.

According to the preferred embodiment of the invention described herein, the chain comprises a plurality of cage-shaped elements connected in succession, said cage-shaped element comprising a central body from which lateral bodies branch off whose free ends are arranged opposite each other, slidingly inserted in another cage-shaped element adjacent to said cage-shaped element and facing the corresponding central body, which also comprises an elastic element interposed between the free ends of the lateral bodies of each cage-shaped element and the central body of the adjacent cage-shaped element.

Advantageously, since each elastic element of the chain is associated with a single cage-shaped element and is independent of the others, said elements are suitable for making elastic chains of any length, using the desired number of cage-shaped elements and associating each of them with a corresponding elastic element.

Still advantageously, the length of the chain can be easily modified by adding or removing one or more cage-shaped elements and the corresponding elastic elements, with no need to modify the rest of the chain and/or to replace the other elements for this reason.

Furthermore, advantageously, the elasticity of the chain allows it to be adapted to the body of the person who wears it.

Finally, the elastic chain can advantageously be made in the shape of a closed ring, with no need for opening devices.

BRIEF DESCRIPTION OF THE DRAWINGS

The object and advantages described above will be highlighted in greater detail in the description of a preferred embodiment of the invention that is supplied as an indicative, non-limiting example with reference to the enclosed drawings, wherein.

DESCRIPTION OF THE INVENTION

Figure 1:
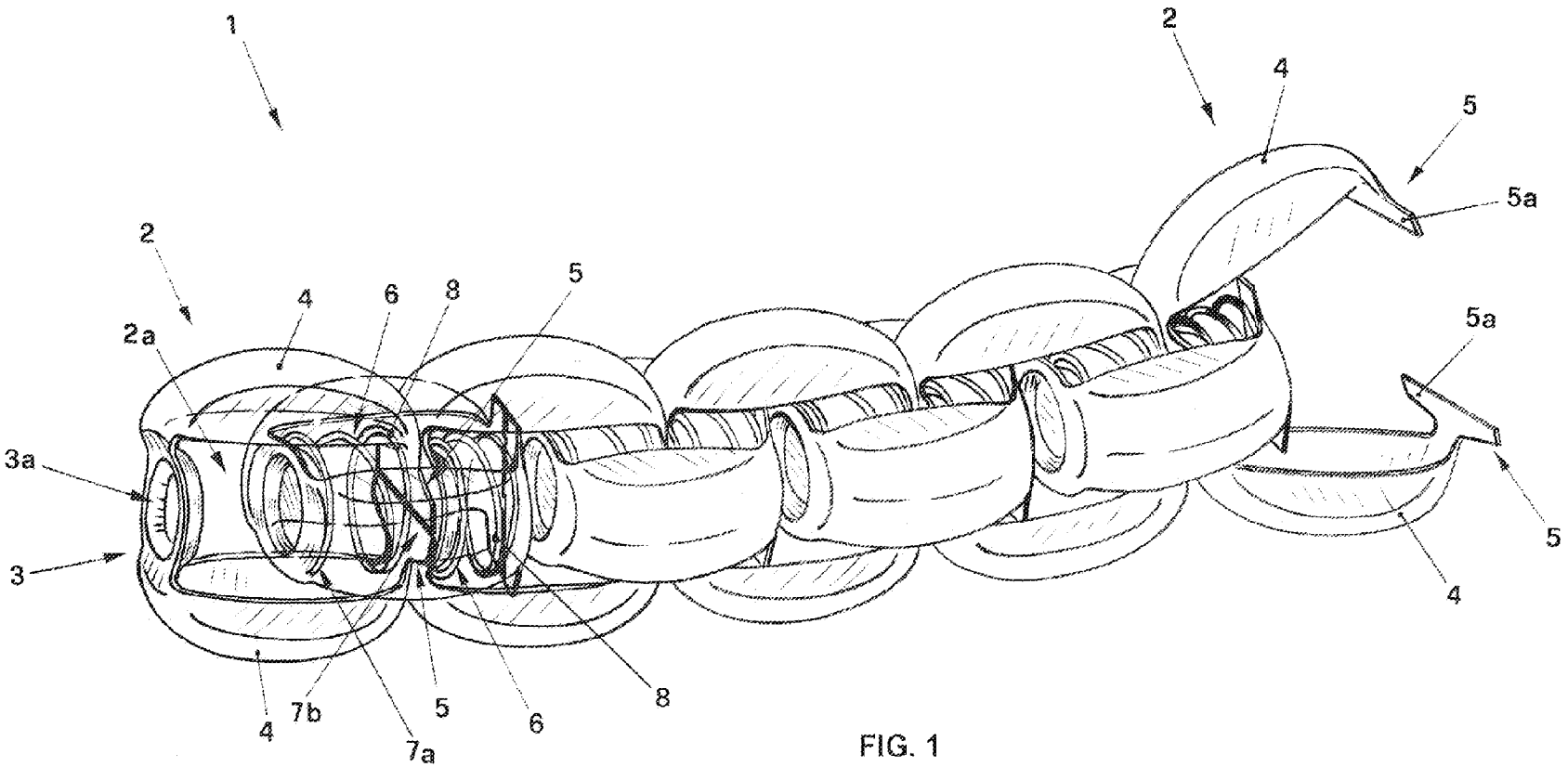
FIG. 1 is an axonometric view, partially in transparency, of the chain carried out according to the invention.

The chain subject of the invention is shown in FIG. 1, where it is indicated as a whole by 1.

It can be observed that it comprises a plurality of cage-shaped elements 2 connected in succession, one of which is shown, open, in FIG. 1.

Obviously, the above mentioned cage-shaped elements 2 can be present in any number, depending on the length of the chain 1.

Figure 2:
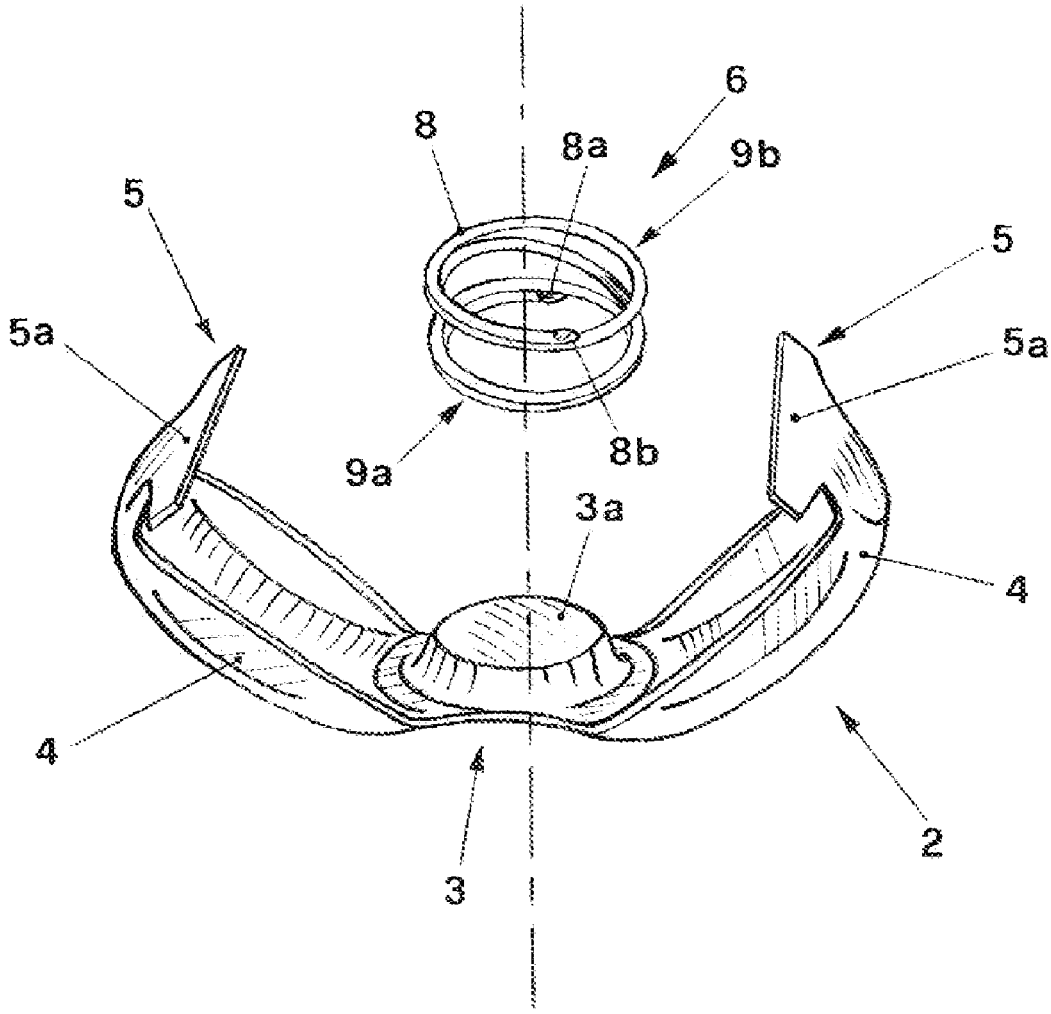
FIG. 2 is an axonometric view of the components of the chain shown in FIG. 1.

As shown in the part represented in transparency in FIG. 1 and, more clearly, in FIG. 2, each cage-shaped element 2 comprises a central body 3 from which two lateral bodies 4 branch off, whose free ends 5 are bent in such a way as to be opposite each other.

It is evident that, in construction variants of the invention, the cage-shaped elements 2 can be provided with more than two lateral bodies 4.

The above mentioned free ends 5 are slidingly inserted in an adjacent cage-shaped element 2, through the slots 2*a* defined on it by the corresponding lateral bodies 4, in order to obtain the connection of the cage-shaped elements 2 with one another.

Each free end 5 is preferably provided with a widened part 5*a* that advantageously prevents it from slipping off the corresponding slot 2*a*, thus avoiding the accidental opening of the cage-shaped element 2 and the consequent interruption of the chain 1.

According to the invention, the chain 1 comprises an elastic element 6 interposed between the free ends 5 of the lateral bodies 4 of each cage-shaped element 2 and the central body 3 of the adjacent cage-shaped element 2, suited to generate an elastic returning action that tends to contract the chain 1.

Therefore, the invention achieves the object to make a chain 1 of the known type described above characterized in that it is elastic.

Advantageously, the special connection described above between the cage-shaped elements 2 and the elastic elements 6 makes it possible to obtain a particularly simple elastic chain 1, since the elastic element 6 acts directly on the cage-shaped element 2 that serves also as a seat for the first one.

Furthermore, since each elastic element 6 is associated with a single cage-shaped element 2, it is easy to understand that it is possible to make a chain 1 having any length, using any number of cage-shaped elements 2 and an equal number of corresponding elastic elements 6.

Therefore, the invention achieves the object to carry out a modular elastic chain 1.

Advantageously, the length of the chain 1 can be easily modified by adding or removing cage-shaped elements 2 and the corresponding elastic elements 6, with no need to replace or modify the other elements of the chain 1 for this reason.

Preferably, the length of each elastic element 6 when it is at rest exceeds the length of the corresponding housing, that is, the distance X between the free ends 5 of any cage-shaped element 2 and the central body 3 of the adjacent cage-shaped element 2, independently of the mutual position of the two cage-shaped elements 2.

In this way, advantageously, the elastic elements 6 are always compressed, at least partially, in such a way as to maintain the chain 1 elastic with any extension.

The free ends 5 of each cage-shaped element 2 and the central body 3 of the adjacent cage-shaped element 2 define a pair of reference surfaces 7*a*, 7*b*, positioned against the two opposite sides of the elastic element 6.

Preferably, said reference surfaces 7*a*, 7*b* are substantially parallel to each other, in such a way as to advantageously provide an optimal support for the elastic element 6.

As shown in the above mentioned FIG. 2, the elastic element 6 is a cylindrical helical spring 8.

It is evident, however, that in construction variants of the invention it will be possible to use a spring 8 having a different shape, or an element different from a spring, provided that it is suitable for reacting elastically to compression.

Preferably and advantageously, each end 8*a*, 8*b* of the above mentioned helical spring 8 is welded to the adjacent turn 9*a*, 9*b*, to prevent the end 8*a*, 8*b* itself from coming out of the cage-shaped element 2 in case of accidental rotation of the helical spring 8.

Furthermore, the central body 3 of the cage-shaped element 2 is preferably provided with a relief area 3*a* facing towards the inside of the cage-shaped element 2 itself, that, moving to the centre of the helical spring 8, advantageously contributes to keeping it in optimal position.

Although not necessary, it is preferable for the free ends 5 of any cage-shaped element 2 to be in contact with each other in order to define a substantially continuous reference surface 7*b* that, advantageously, provides an optimal support for the elastic element 6.

As to the cage-shaped elements 2, they are preferably made of sheet, in particular of a precious metal.

However, they can also be made of a different material, provided that it is deformable, in order to allow assembly of the chain 1.

Figure 3:
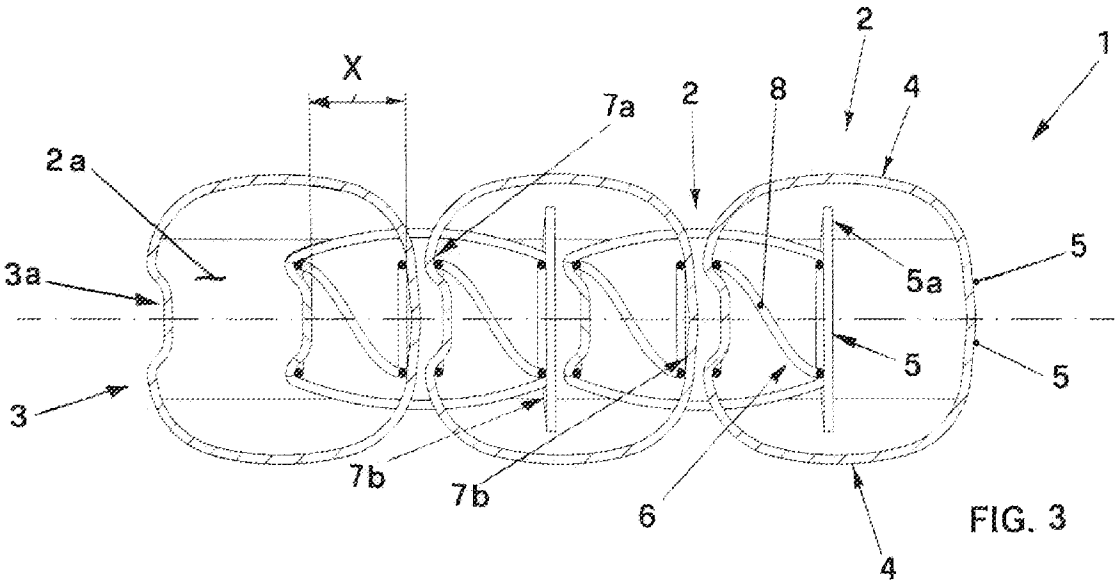
FIGS. 3 and 4 show a section of the chain shown in FIG. 1 in different operating positions, in a section view according to the longitudinal plane.
Figure 4:
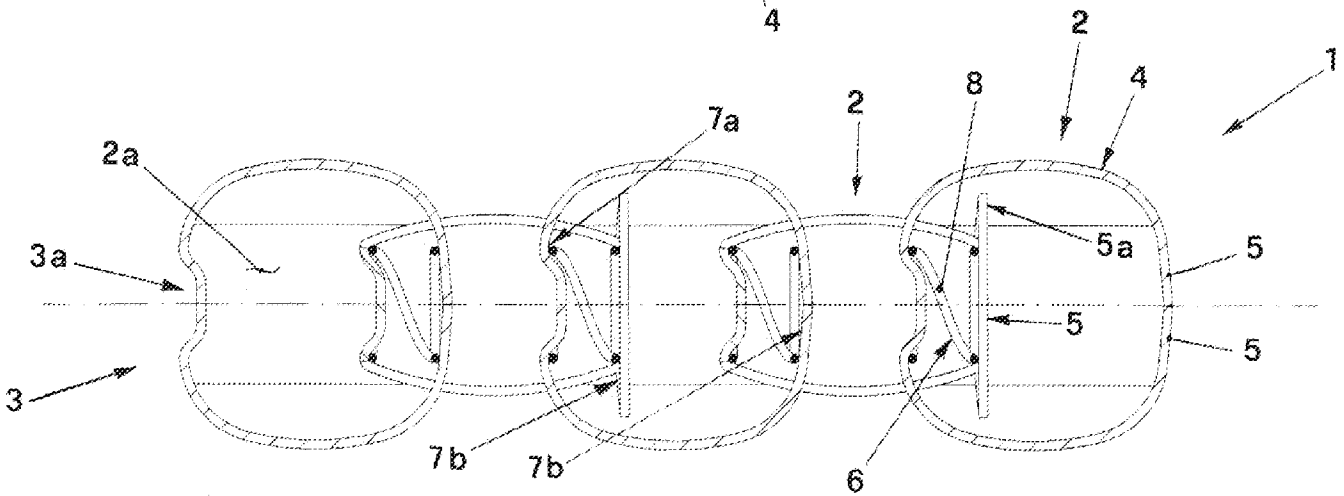

In practice, and as shown in the sections of FIGS. 3 and 4, when the chain 1 is stretched, the cage-shaped elements 2 move away from each other and the free ends 5 of each of them slide in the slots 2*a* of the adjacent cage-shaped element 2, thus compressing the corresponding elastic element 6 which reacts with a direct elastic returning action in the direction of contraction of the chain.

Figure 5:
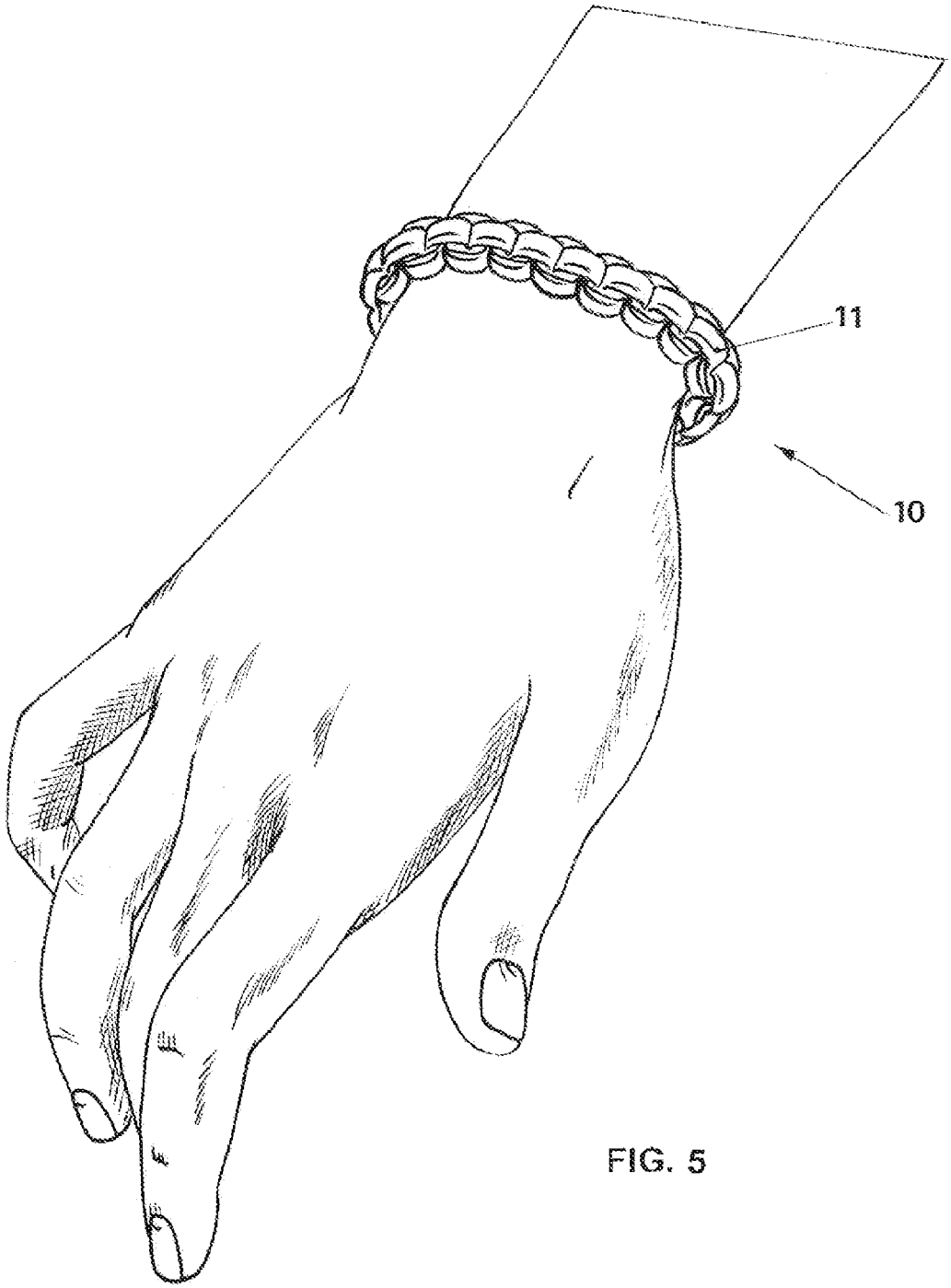
FIG. 5 shows an ornamental item comprising the chain shown in FIG. 1.

It is clear that a chain of the type described above can be used to make an ornamental item 10, for example a bracelet or a necklace, an example of which is shown in FIG. 5.

It can be easily understood that the elasticity of the chain 11 makes it possible to carry out ornamental items 10 that are closed to form a ring and therefore without opening devices, which represents an advantage in terms of aesthetical appearance, ease of production and ease of use.

In fact, an elastic ornamental item 10 can be stretched in order to put it on and fits tightly to the body owing to the elastic returning action of the chain 11.

In the light of the above considerations, the invention achieves all the previously-stated objects.

In particular, the presence of the elastic element achieves the object to make a chain of the known type described above characterized in that it is elastic.

Furthermore, the invention also achieves the object to make an entirely modular elastic chain by using elastic elements, each one of which is associated with a corresponding cage-shaped element and is independent of the other elastic elements.

In the construction stage, further changes or construction variants of the chain of the invention that are not described and represented in the drawings may be carried out.

Said changes or construction variants must all be considered protected by the present patent, provided that they fall within the scope of the claims expressed below.

Where technical features mentioned in any claim are followed by reference signs, those reference sings have been included for the sole purpose of increasing the intelligibility of the claims and accordingly such reference signs do not have any limiting effect on the interpretation of each element identified by way of example by such reference signs.

The invention claimed is:

1. Chain comprising a plurality of cage-shaped elements connected in succession, wherein each said cage-shaped element comprises a central body, two or more lateral bodies that branch off from the central body and have free ends that are arranged opposite each other, adapted to slidingly insert in an adjacent cage-shaped element of said chain facing the central body of the adjacent cage-shaped element, and an elastic element interposed between the free ends of said lateral bodies and said central body of the adjacent cage-shaped element.

2. Chain according to claim 1, wherein said elastic element includes two opposite sides, and said free ends of the lateral bodies of each one of said cage-shaped elements and said central body of the adjacent cage-shaped element define a pair of reference surfaces parallel to each other and positioned against the two opposite sides of said elastic element.

3. Chain according to claim 1, wherein said elastic element includes two opposite sides, and a length between the opposite sides of said elastic element when said elastic element is at rest exceeds a distance between said free ends of the lateral bodies of any cage-shaped element and said central body of the adjacent cage-shaped element.

4. Chain according to claim 1, wherein said elastic element is an helical spring.

5. Chain according to claim 4, wherein said helical spring is cylindrical.

6. Chain according to claim 4, wherein each end of said helical spring is welded to an adjacent turn of said helical spring.

7. Chain according to claim 1, wherein said central body presents a relief area facing towards the free ends of said lateral bodies of said cage-shaped element in order to maintain said helical spring in position.

8. Chain according to claim 1, wherein said free ends of any cage-shaped element are in contact with each other.

9. Chain according to claim 1, wherein said cage-shaped elements are constructed of deformed sheet material.

10. Ornamental item suited to be worn, comprising at least one chain according to claim 1.

11. Ornamental item according to claim 10, wherein said chain forms a closed geometric figure.

12. Ornamental item according to claim 10, consisting of a necklace.

13. Ornamental item according to claim 10, consisting of a bracelet.

14. Chain according to claim 5, wherein each end of said helical spring is welded to an adjacent turn of said helical spring.

15. Ornamental item according to claim 11, consisting of a necklace.

16. Ornamental item according to claim 11, consisting of a bracelet.

* * * * *